US012584704B1

(12) United States Patent
Hager, IV et al.

(10) Patent No.: US 12,584,704 B1
(45) Date of Patent: Mar. 24, 2026

(54) AMMUNITION FEED BELT LINKAGE BRACKET

(71) Applicants: Carl Emmett Hager, IV, California, MD (US); Shawn E. Allen, King George, VA (US); Matthew D. Lehr, King George, VA (US); George Arthur Anderson, Stafford, VA (US)

(72) Inventors: Carl Emmett Hager, IV, California, MD (US); Shawn E. Allen, King George, VA (US); Matthew D. Lehr, King George, VA (US); George Arthur Anderson, Stafford, VA (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 0 days.

(21) Appl. No.: 18/975,010

(22) Filed: Dec. 10, 2024

(51) Int. Cl.
*F41A 9/33* (2006.01)
*F42B 39/08* (2006.01)
*F41A 9/57* (2006.01)

(52) U.S. Cl.
CPC ..... *F41A 9/33* (2013.01); *F42B 39/087* (2013.01); *F41A 9/57* (2013.01)

(58) Field of Classification Search
CPC ..... F41A 9/33; F41A 9/54–58; F42B 39/087
See application file for complete search history.

(56) References Cited

U.S. PATENT DOCUMENTS

| | | | | | |
|---|---|---|---|---|---|
| 2,622,483 | A * | 12/1952 | Kinzelman | F41A 9/54 | 89/33.1 |
| 3,307,452 | A * | 3/1967 | Meunier | F41A 9/57 | 89/33.14 |
| 3,563,357 | A * | 2/1971 | West | F41A 9/57 | 198/861.2 |
| 4,004,491 | A * | 1/1977 | Seeling | F41A 9/31 | 89/35.01 |
| 4,662,263 | A * | 5/1987 | Titemore | F41A 9/57 | 89/33.14 |
| 8,752,466 | B1 * | 6/2014 | Howell | F41A 9/57 | 89/33.14 |

* cited by examiner

*Primary Examiner* — Bret Hayes
(74) *Attorney, Agent, or Firm* — Gerhard W. Thielman

(57) ABSTRACT

A guidance tab is provided for separating a cartridge round at its base from an aft linkage bracket within an ammunition chain. The tab includes a plate, a pair of legs and a pair of feet, and is composed of polyamide-imide. The plate has an obverse surface for engaging the base of the cartridge round and a reverse surface for engaging the aft linkage bracket. The plate is oriented along a longitudinal direction of the ammunition train and a lateral direction orthogonal to an axial direction of the cartridge round. The pair of legs extends from flanking sides of the plate in the axial direction towards the aft linkage bracket. The pair of feet extend substantially parallel to the plate. Each foot extends from a respective leg of the pair of legs.

6 Claims, 5 Drawing Sheets

AMMUNITION FEED BELT LINKAGE BRACKET

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to ammunition feed linkages. In particular, the invention relates to spacer tabs that separate ammunition rounds from their guided feed system while mitigating electromagnetic hazards.

The United States Navy employs guns for firing 20 mm ammunition. Such guns include the M61 Vulcan cannon for Phalanx and M197 gatling gun. Modern militaries employ such guns fed by cartridge belts, which are pulled by the gun's feed mechanism. A cartridge chain concatenates ammunition rounds to form the belt of bullets fired from the guns.

Solid-state radar systems are significantly increasing the Navy shipboard operational electromagnetic environment (EME) onboard numerous Naval platforms. Legacy ordnance systems are being evaluated to the increased EMEs to ensure that ordnance are not inadvertently duded or initiated, specifically through Hazards of Electromagnetic Radiation to Ordnance (HERO) testing.

Electrically primed 20 mm ammunition has been evaluated for HERO and determined to be HERO susceptible to EMEs in multiple frequency bands when platform loaded on aircraft. Hence, safety for personnel and equipment necessitates HERO Emissions Control (EMCON) for specific Naval transmitter systems (i.e., reduced power, sectoring, etc.) during aircraft departure and recovery. Such restrictions have significant potential to affect ship performance and compromise her crew's mission.

Aircraft gun configurations include an ordnance container (or drum), a feed chute which carries the ammunition from the drum to the gun, a feeder system to pull the rounds through the chute and the gun. Un-commanded 20 mm round initiation has occurred during a HERO test. Investigation and analysis revealed causation by capacitive coupling between metal tabs on the aft of feed chute to the 20 mm electric primer.

At frequencies in X-Band, the metal tab of the radiation hazard (RADHAZ) link and/or the feed chute act as a patch antenna with resonant frequency determined by the distance between the tab and the 20 mm primer. Similarly in S-Band, the chute assembly itself acts as a receive antenna capacitively coupling sufficient energy to inadvertently initiate the 20 mm primer.

This effect has been verified both experimentally and through modeling and simulation (M&S) with consistent results. The most cost effective option to mitigate HERO was determined to be through modification of the 20 mm feed chute, because these items have the most limited service life and have to be replaced often.

SUMMARY

Conventional ammunition linkages yield disadvantages addressed by various exemplary embodiments of the present invention. In particular, exemplary embodiments provide a guidance tab for separating a cartridge round at its base from an aft linkage bracket within an ammunition chain. The tab includes a plate, a pair of legs and a pair of feet, and is composed of polyamide-imide. The plate has an obverse surface for engaging the base of the cartridge round and a reverse surface for engaging the aft linkage bracket. The plate is oriented along a longitudinal direction of the ammunition train and a lateral direction orthogonal to an axial direction of the cartridge round. The pair of legs extend from flanking sides of the plate in the axial direction towards the aft linkage bracket. The pair of feet extends substantially parallel to the plate. Each foot extends from a respective leg of the pair of legs.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

Figure 1:
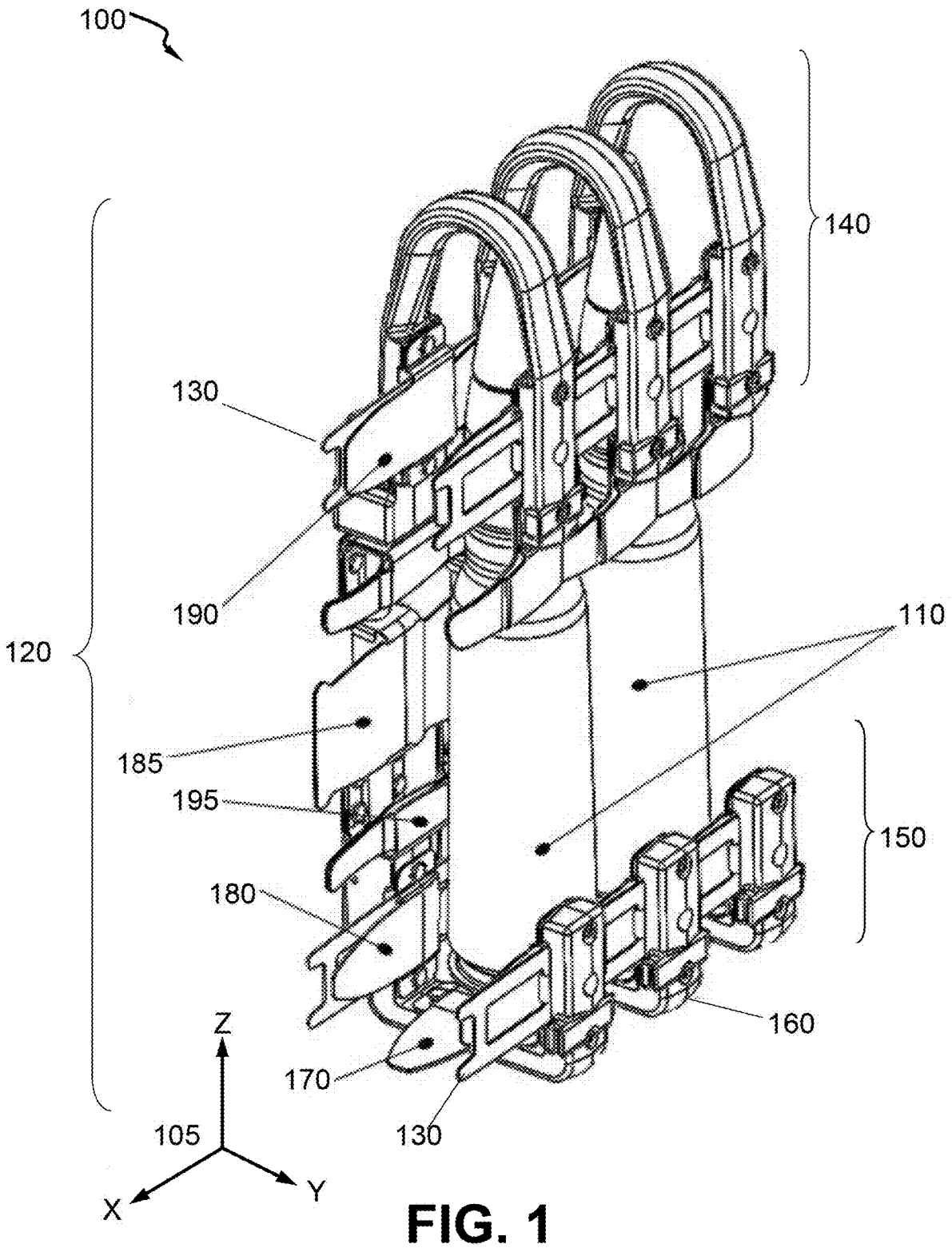
FIG. 1 is a perspective view of a cartridge linkage subassembly.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The disclosure generally employs quantity units with the following abbreviations: length in meters (m) or inches ("), mass in grams (g), time in seconds(s), angles in degrees (°), force in newtons (N), temperature in kelvins (K) or degrees fahrenheit (° F.), energy in joules (J), potential in volts (V), electric current in amperes (A) and frequencies in hertz (Hz).

The purpose of this design is to mitigate a Hazards of Electromagnetic Radiation to Ordnance (HERO) issue for aircraft utilizing 20 mm gun systems. Feed chutes load ammunition belts to the guns for firing rounds contained therein. Both modeling and simulation (M&S) and laboratory testing reveal that 20 mm ammunition can be inadvertently initiated when exposed to emerging EMEs. The exemplary 20 mm feed chute component design mitigates this vulnerability by selecting appropriate materials and designing a new cartridge guide shape, while nonetheless satisfying all structural, reliability and environmental requirements for the feed chute.

Ammunition must be stowed in an orderly fashion to maximize the number of rounds that available to a gun. Storage and delivery of the rounds can be adequately accomplished by an ammunition handling system (AHS). The gun must be steerable so as to be able to point towards targets. This imposes variability of the gun's orientation relative to the AHS.

A feed chute connects the AHS to the gun, and offers adequate flexibility to enable continuous transfer of ammunition between them. This transfer occurs along a belt path suitable for articulation of the retention links used between each concatenated ammunition round in the belt.

Feed chutes must be able to flex in a variety of directions, often concurrently along multiple compound angles while traveling along the feed chute's path. The feed chute must be able to swiftly and repeatedly reposition into new orientations as the gun system rapidly maneuvers during operations to effectively engage targets in a timely manner. This must be accomplished without binding up the continuous delivery of the ammunition rounds.

Feed chutes must be able to function properly in various severe operational conditions, often concurrently. Therefore, any alteration to an already fielded feed chute must be compatible with these same conditions. To preclude reduction in operation capabilities, high level requirements were developed to measure them against for suitability. These requirements were:

- electrical properties that act as an insulator.
- mechanical properties comparable to stainless steel from −60° F. to +160° F.
- burn characteristics acceptable per Federal Aviation Administration (FAA).
- acceptable reliability and durability in expected environments.
- acceptable life cycle costs.
- fits within platform being investigated.
- replicates current response to dynamic movements during operations.

FIG. 1 presents an example in a perspective view 100 with a compass rose 105 of a partial ammunition feed chute for loading 20 mm cartridge case assemblies 110 (also called "rounds") within cartridge case subassemblies 120 that concatenate as an ammunition chain or belt and slide along rails 130. The compass rose 105 provides Cartesian coordinates in the belt longitudinal X, lateral port Y and cartridge axial Z directions. Ammunition travels along the X direction, while the Z direction in relation to the gun (not shown) points from breech to muzzle for reference. Artisans of ordinary skill will recognize that 20 mm ammunition is merely exemplary and not limiting, although primary analysis and design has emphasized the 20 mm configuration.

Upper (i.e., towards the gun's muzzle) linkages 130 include hoops (over the cartridge tips) that connect to proximal flanges held by corresponding proximal clamps. Lower (i.e., towards the gun's breech) linkages 150 include retention brackets 160 held by distal clamps. Bottom guides 170 separate the rounds 110 from the brackets 160 while riding along the linkages 140 and 150. The bottom guides 170 constitute spacer tabs to ensure separation between rounds 110 and the brackets 160.

Additional sets of transverse guides include lower transverse 180, mezzanine 185, upper transverse 190 and intermediate 195. These guides 170, 180, 185, 190 and 195 are typically composed of stainless steel for durability. Such guides engage the linkages 140 and 150 to enable the case subassembly 120 to translate with the round 110 through the feed chute. The lower and upper transverse guides 180 and 190 inhibit lateral wobble by the round 110.

Figure 2A:
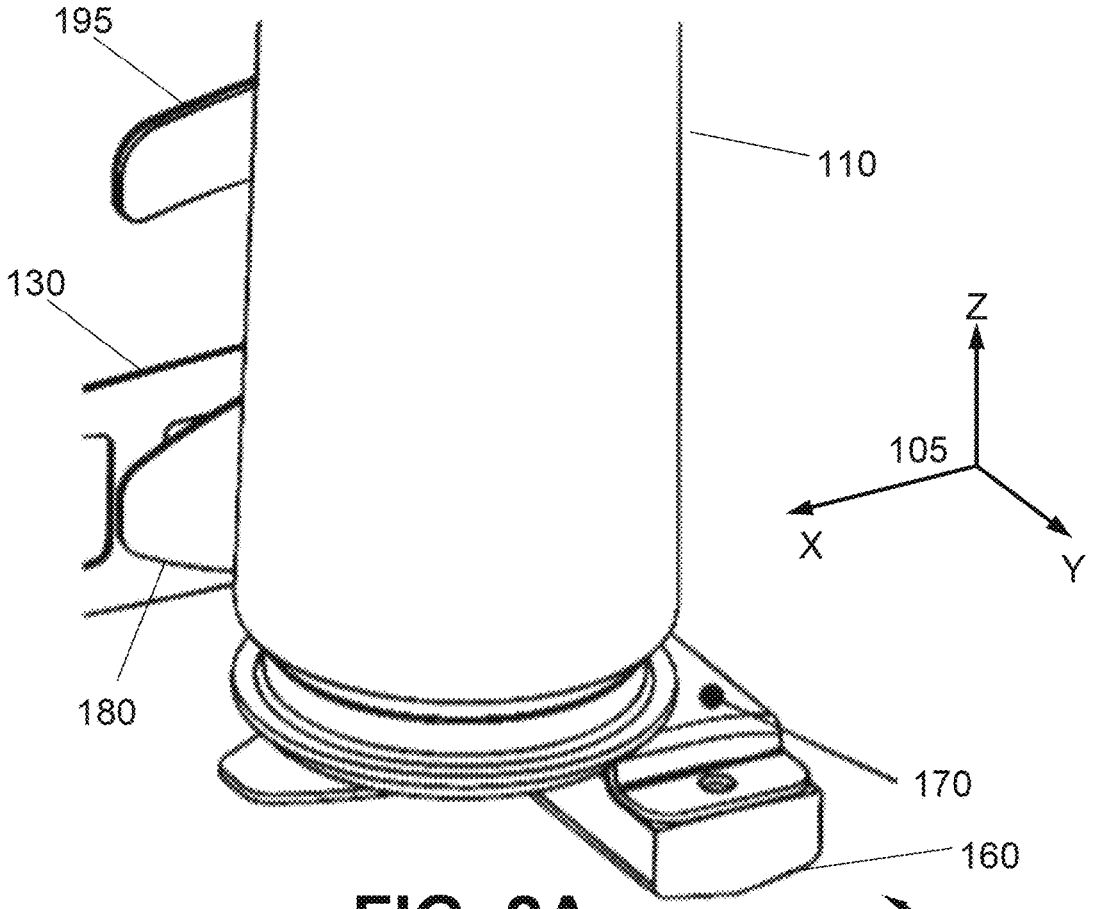
FIGS. 2A and 2B are isometric detail views of the subassembly.
Figure 2B:
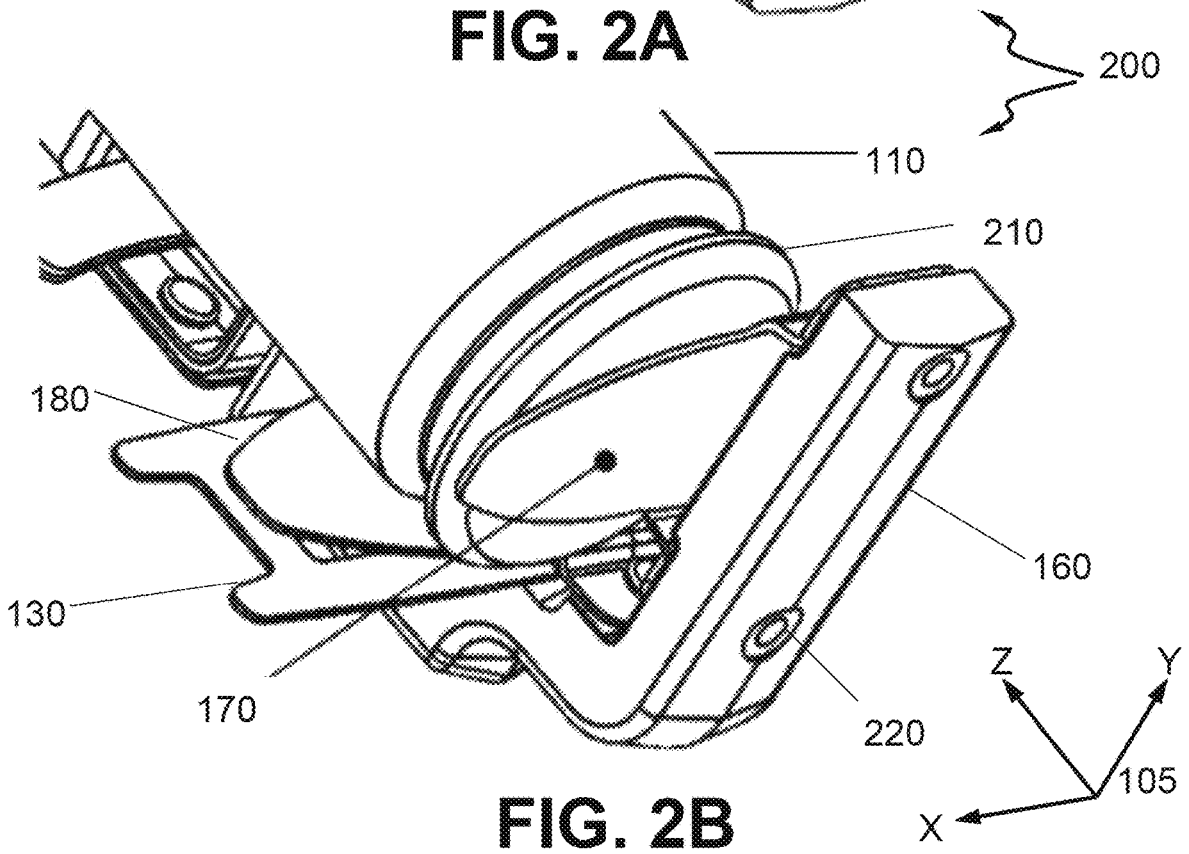

FIGS. 2A and 2B show isometric views 200 of the cartridge case subassembly 120 towards the breech end with corresponding compass roses 105. FIG. 2A presents the perspective from offset the muzzle, while FIG. 2B illustrates observation from offset the breech. The aft base 210 of the round 110 rests on the bottom guide 170, which rides on the bracket 160. Rails 130 passing between the transverse guides 180 and 190 and the linkages 140 and 150 provide continuity between subassemblies 120. The bracket 160 secures the guide 170 via a pair of rivets 220, each of which pass through aligned corresponding through-holes.

The exemplary bracket 160 and bottom guide 170 as components to the lower linkages 150 are modified from the conventional by modest alterations in geometry, as well as substitution of composition material from an electrically conductive metal to a rigid polymer. Under HERO, the conventional bottom guide permits inadvertent initiation of the primer in the cartridge round 110. Replacing electrically conductive stainless steel with a dielectric insulator as exemplary bracket 160 and bottom guide 170 becomes necessary due to higher electromagnetic energy from radar upgrades that threaten HERO reaction.

Such substitution for the bracket 160 and guide 170 that the base 210 of the round 110 rides against while traveling through the ammunition chute requires a material that would mechanically behave similarly to steel in operational conditions. A search for the material that satisfies the requirements identified polyamide-imide (PAI) as a candidate. PAI constitutes an amorphous polymer that possesses appropriate properties, such as high strength and melt processibility, heat tolerance and chemical resistance.

Solvay Specialty Polymers under tradename Torlon® represents a prominent distributor of PAI materials. Various types of Torlon® are available, and properties vary per type. To replace stainless steel for the bottom guide 180, injection molded Torlon® 5030 plastic was selected. PAI material properties can be read at https://www.professionalplastics-.com/professionalplastics/content/Torlon5030datasheetPAI.pdf for reference. Note that Torlon® 5030 includes 30% glass-fiber reinforcement, with thermal expansion similar to aluminum.

Initial calculations for use of injection molded Torlon® 5030 show that when the component is made thicker, the exemplary guide 180 provides:

- almost the same displacement with stainless steel throughout the range of operational temperatures at maximum allowable loads.
- an expected life cycle between 105 and 107 at maximum deflection loads, with operational use at less than peak loads expected to endure even longer.
- wear characteristics sufficient for life cycle requirements.
- an increase in range of allowable component deflection during use.
- an acceptable number of cycles for fatigue strength in all conditions.

Figure 3A:
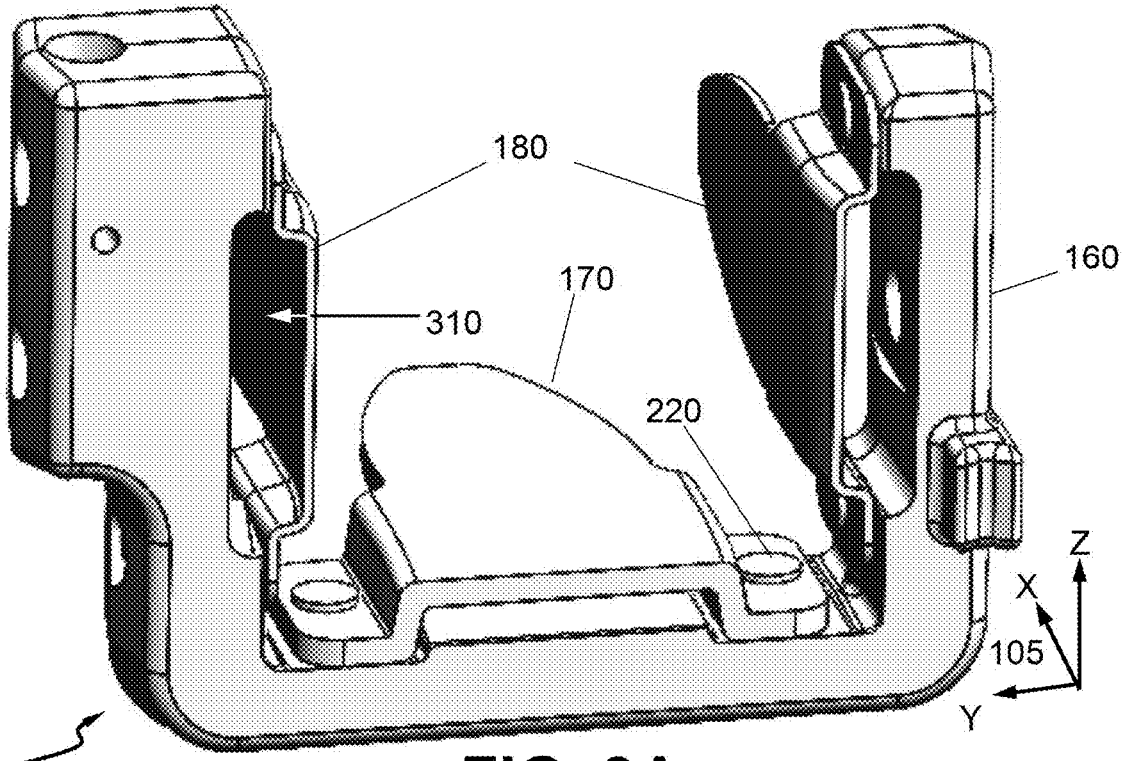
FIGS. 3A and 3B are isometric assembly views of bracket components.
Figure 3B:
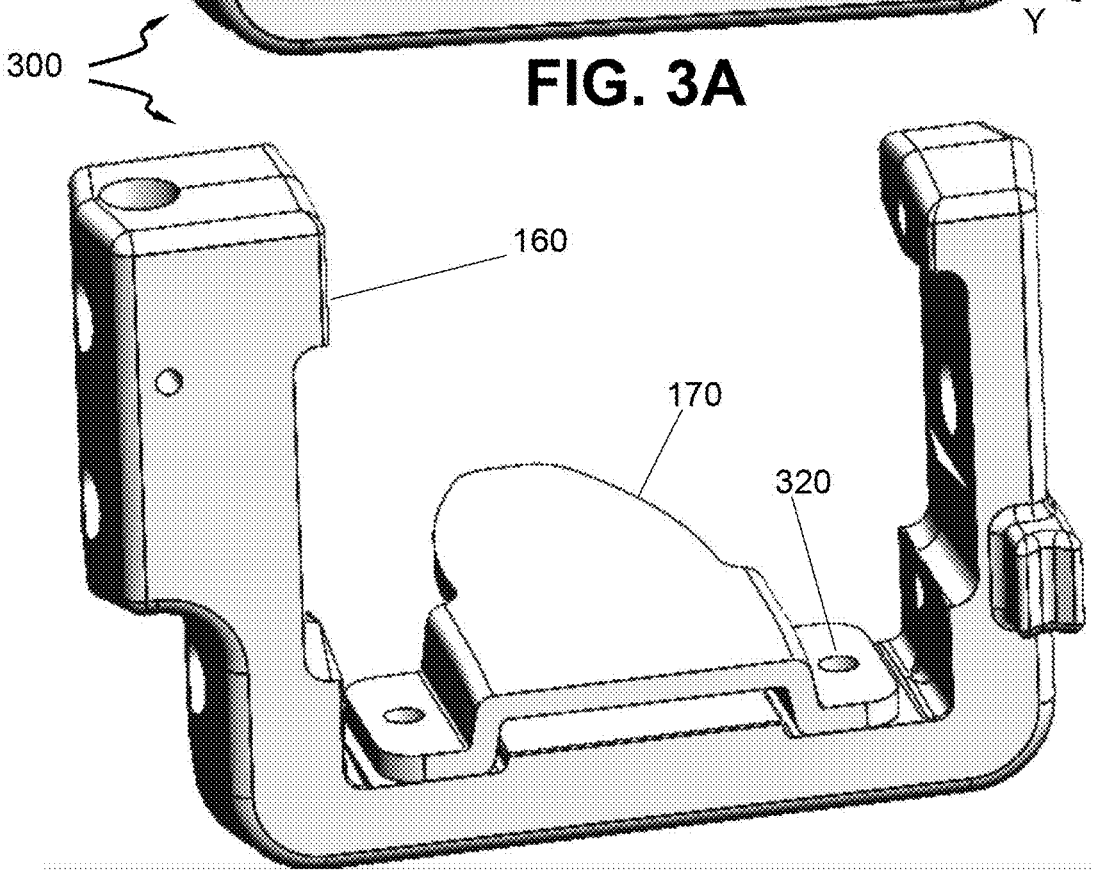

FIGS. 3A and 3B show isometric assembly views 300 of bracket components for the lower linkages 150, including a compass rose 105 for orientation. The bottom guide 170 and the transverse guide 180 are shown mounted to the bracket 160 of the lower linkage 150. The rails 130 pass through gaps 310 between the guides 180 and the bracket 160. In FIG. 3B, the guides 180 and rivets 220 are omitted for clarity, displaying through-holes 320 in the guide 170.

Figure 3C:
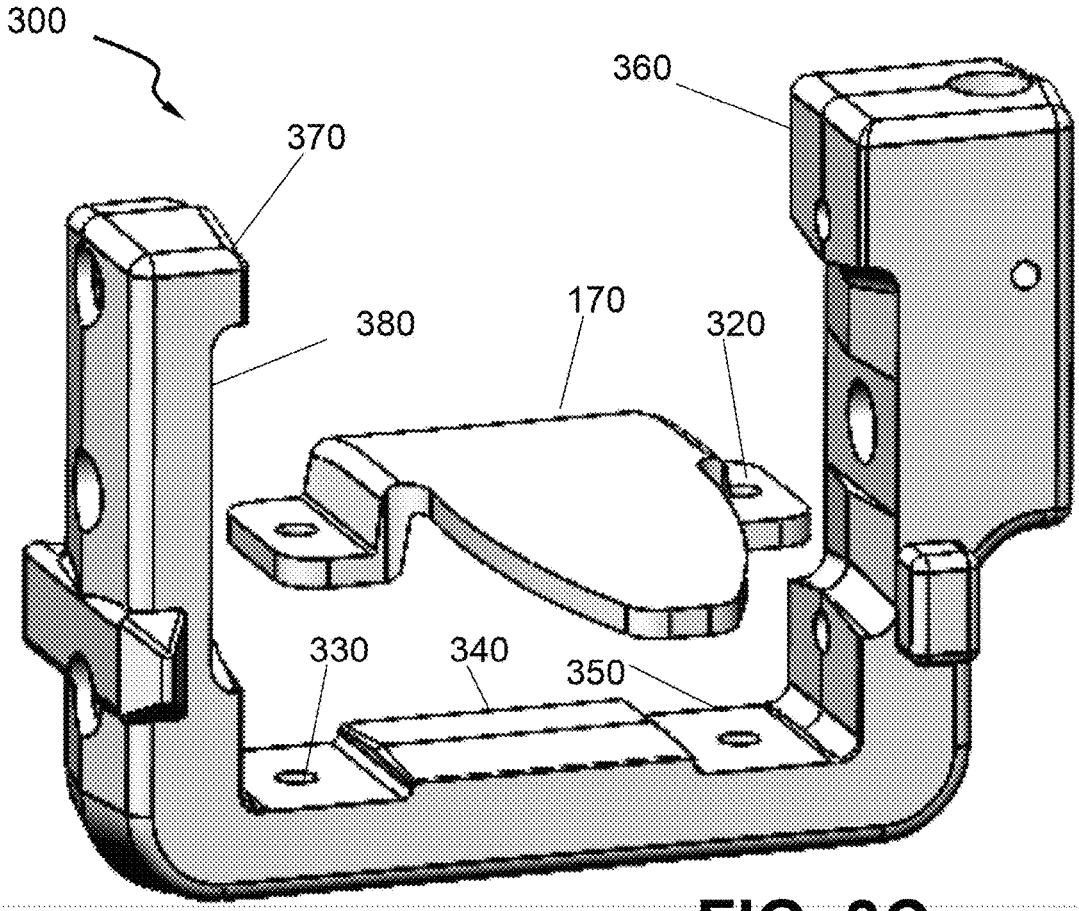
FIG. 3C is an isometric exploded view of bracket components.

FIG. 3C shows an isometric exploded view 300 of bracket components with the guide 170 levitated above the bracket 160, showing through-holes 330 in the bracket 160, which includes a base span 340 with flat indentions 350 for receiving the guide 170, and include the holes 330. Port and starboard arms 360 and 370 flank the span 340 for attaching their respective lateral guides 180. Indents 380 on the arms 360 and 370 provide the gaps 310 that enable passage of the rails 130.

Figure 4A:
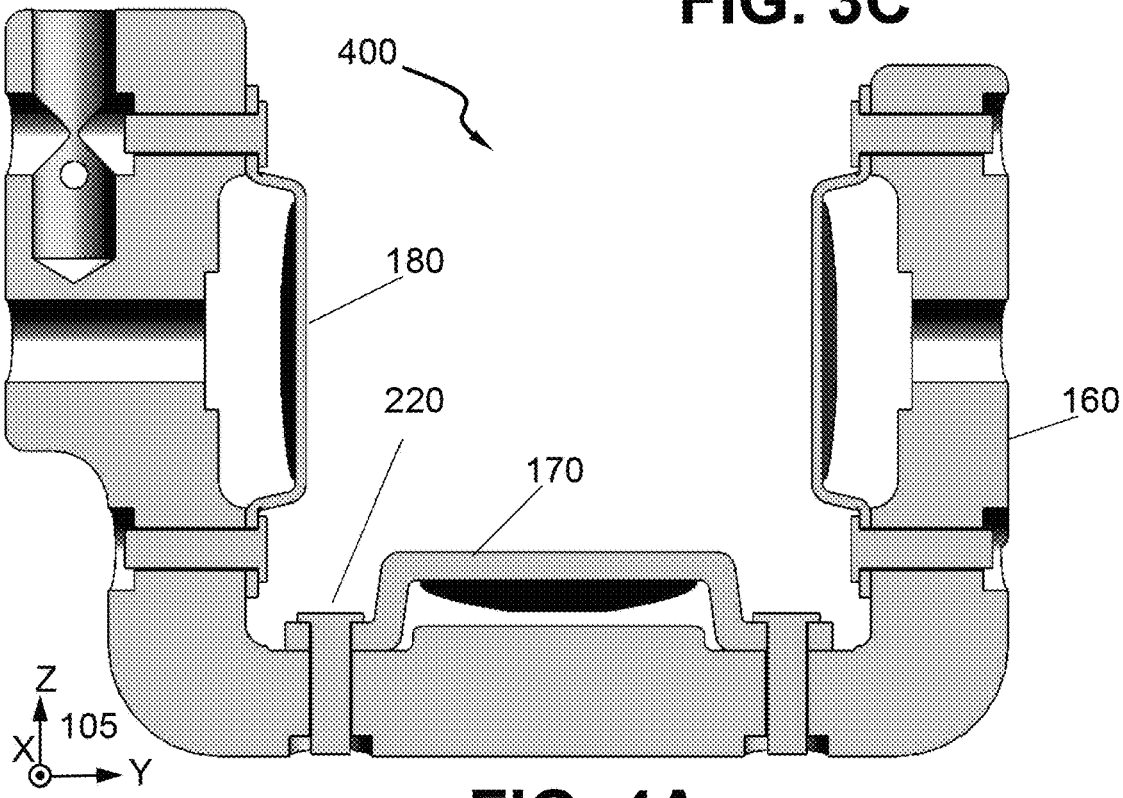
FIGS. 4A and 4B are elevation cross-section views of bracket components.
Figure 4B:
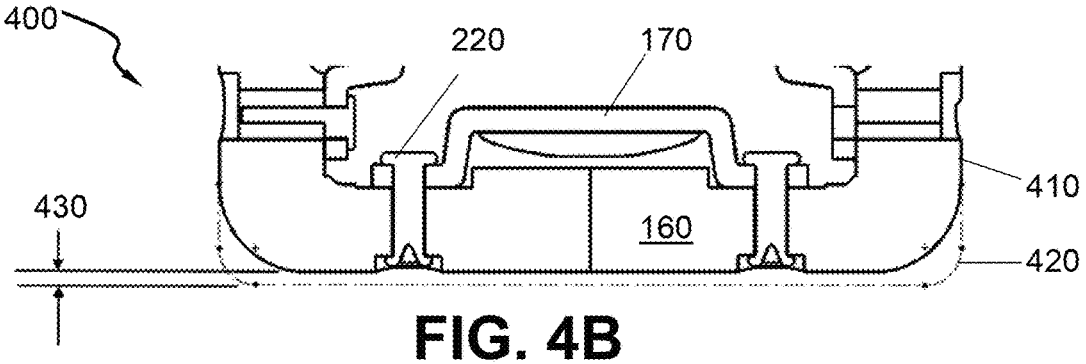

FIGS. 4A and 4B show elevation cross-section views 400 of the cartridge case subassembly 120 towards the breech end, along with a compass rose 105 for orientation, with the former illustrating components from FIG. 3A, while the latter presents a detail region. In particular, the reformed geometry outline 410 for the exemplary bracket 160 can be compared to the conventional geometry outline 420 for that component's predecessor that employs a stainless steel conventional bottom guide. A vertical gap 430 compensates for the increased thickness of the reformed PAI guide 170 as compared to that component's conventional stainless steel version.

Design efforts have been conducted that enable incorporating the thicker component made from PAI, while maintaining required dimensional control of inside surfaces of feed chute assembly. Redesign of the bracket 160 that the bottom guide 170 mounts to has also been accomplished. This presumably enables present feed chute vendor to continue using currently operable fabrication tools, while enabling insertion of the new design for future production at a preferred time, with minimal changes. This was accomplished by using the same length and type of rivets 220 currently in operation.

Figure 5:
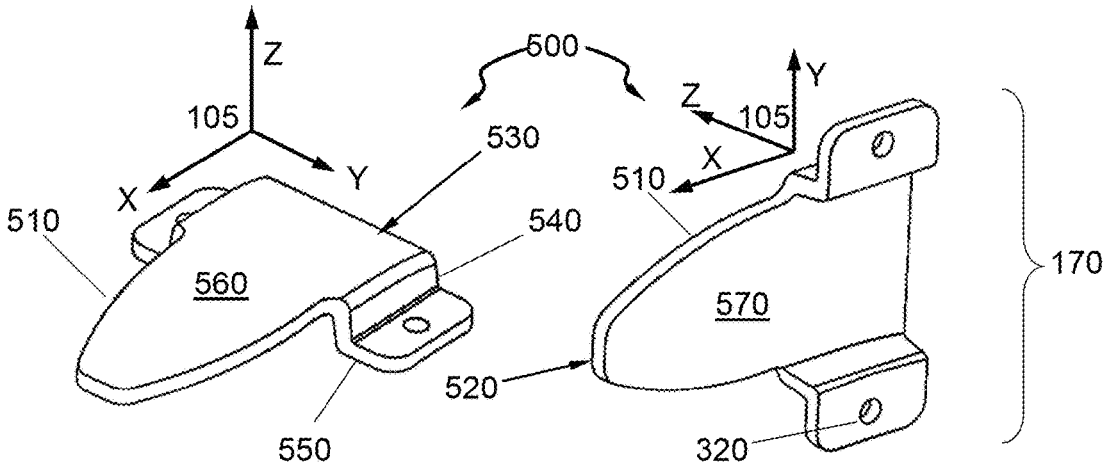
FIG. 5 is a set of isometric views of a bottom guide.

FIG. 5 shows isometric views 400 of the bottom guide 170. The left illustration shows the guide 170 from offset the muzzle, while the right illustration shows the guide 180 from offset the breech, both clarified by respective compass roses 105. In the configuration presented, the bottom guide 170 constitutes a unitary component with a plate 510 having a fore nose 520 towards the feed chute and an aft tail 530 towards the stowage magazine (not shown).

A pair of flanking legs 540 extend axially adjacent the tail 530, and a pair of feet 550 extend outwardly from the legs 540. Each foot 550 includes a through-hole 320 corresponding to the hole 330 at the base 340 of the bracket 160 to receive the rivet 220. The plate 510 includes an obverse surface 560 that supports the round 110, and a reverse surface 570 that faces the bracket 160.

The plate 510 is oriented along a longitudinal direction (X) of the ammunition train and a lateral direction (Y) orthogonal to an axial direction (Z) of the cartridge round 110. The pair of legs 540 extends from flanking sides of the plate 510 in the axial direction (Z) towards the aft linkage bracket. The pair of feet 550 extends substantially parallel to the plate 510 outward from the plate 510. The exemplary bracket 160 does not actually bend, but extends to provide relief by lowering the mounting surface for the exemplary guide 170 that has been thickened to accommodate its material substitution.

Figure 6:
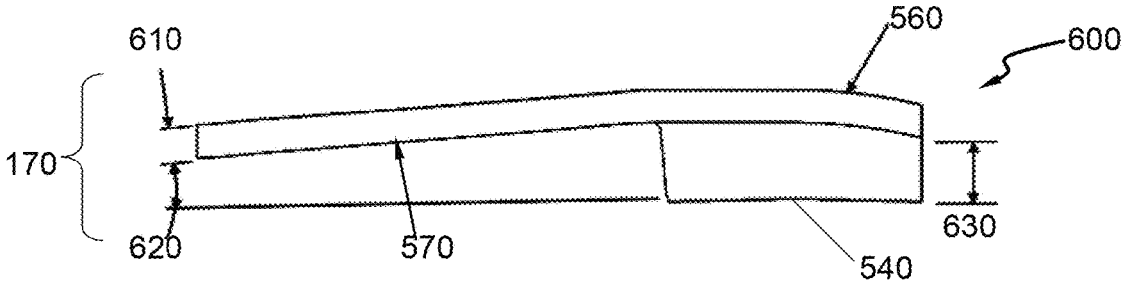
FIG. 6 is an elevation cross-section view of the bottom guide.

FIG. 6 shows an elevation cross-sectional view 600 of the bottom guide 180 featuring dimensional alterations as a consequence of material substitution of PAI from stainless steel. In particular, the thickness 610 and slope angle 620 of the plate 510 increase from 0.025" and 2.0° for steel to 0.065 "and 4.46° for PAI. In addition, the height 630 of the legs 540 increases from 0.0772" for steel to 0.1292" for PAI. Stainless steel has a density of 7.93 g/cm$^3$, compared to Torlon® 5030 of 1.61 g/cm$^3$, which is about one-quarter that of steel.

The PAI component for the bottom guide 180 has greater thickness 410 than the original stainless steel counterpart. This provides sufficient material to ensure that the guide 180 provides the same dynamic response to loads as the original design. Because of this, the redesigned feed chute assembly is expected to operate functionally the same as currently.

Changes in thickness 610 of the guide 170 due to additional material required the part to have a higher clearance from its bracket 160 than conventionally. This change was designed to provide the same clearance between the replacement PAI component and its bracket 160 as originally existed with the conventional steel component. This ensures the feed chute maintains its mobility in the different directions that already exist. The angle 620 of the slope of the guide 170 increases slightly, providing the same clearance between itself and the bracket 160 forward as previously existed.

The exemplary guide 170 produced from PAI enables the chute to contort into the same positions as before, while using a lower percentage of its deflection capabilities than when previously composed from stainless steel. This increases the life cycle of the guide 170 without significantly increasing the replacement rate of feed chutes, if at all.

The exemplary guide 170 composed of PAI is not electrically conductive, which inhibits antenna behavior. This prevents initiation of a round 110 while in the feed chute due to HERO. Should additional testing suggest other components in nearby proximity cause issues, they too can be made from Torlon® PAI. Because the bracket 160 is already being modified, incorporating these both components fabricated from PAI would entail the same overall geometry and capability as conventionally, but with greatly improved HERO resistance. Existing feed chutes expect to be remanufactured to the exemplary HERO-safe design by removing the previous guides and brackets and replacing with the PAI substitutes.

Mitigation options for this HERO issue were investigated and determined to fall in three categories: (1) replacement of 20 mm electrically primed guns and ammunition with percussion primed guns and ammunition for all aircraft configurations, (2) increase the shielding effectiveness (SE) of the aircraft around the feed chute and gun assemblies to reduce the incident EME on the ammunition, and (3) to redesign the chute to act as a less efficient antenna or mitigate the radio frequency (RF) coupling path to the 20 mm primer.

Navy leadership determined that the first option of replacing all legacy electrically primed guns and ammunition with percussion primed is extremely costly and would significant impact the Navy's current inventory of 20 mm ammunition. Additionally, current Navy aircraft employing 20 mm gun configurations have been in the fleet for many years, and modification of the aircraft for the second option to increase SE around the gun would adversely affect aerodynamics, weight, center of mass, etc. and hence rejected as not being a cost effective option. The most cost effective third option to mitigate the HERO issue was determined to be through modification of the 20 mm feed chute, because these items have the shortest service life and must be replaced often.

The United States Department of Defense (DoD), as well as other foreign counties use 20 mm gun systems on aircraft which are exposed to significant EMEs on ships or land based facilities. The material change and modified 20 mm feed chute design has a significant number of use cases for various aircraft systems which may be affected by emerging transmitter systems leveraging solid-state technology. There are also ground and sea-based applications of HERO-susceptible systems that would benefit from this solution. As alternative approaches to mitigate this HERO threat have significantly more costs, there will likely be significant interest in this design.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An aft linkage assembly for supporting a cartridge round in transport within an ammunition chain, said assembly facing a breech end of a gun into which said cartridge round loads, and comprising:

a linkage bracket for supporting the cartridge round within the ammunition chain; and a guidance tab attaching to said linkage bracket and separating the cartridge round at its base from said linkage bracket, wherein said guidance tab is composed of polyamide-imide (PAI) and further comprises:

a plate having an obverse surface for engaging the base of the cartridge round and a reverse surface for engaging said linkage bracket, said plate being oriented along a longitudinal direction of the ammunition chain and a lateral direction orthogonal to an axial direction of the ammunition round;

a pair of legs extending from flanking sides of said plate in said axial direction towards said linkage bracket; and a pair of feet extending substantially parallel to said plate, each foot from a respective leg of said pair of legs.

2. The aft linkage assembly according to claim 1, wherein at least a pair of rivets attaches said guidance tab to said linkage bracket.

3. The aft linkage assembly according to claim 1, wherein said PAI includes glass fiber.

4. A guidance tab for separating a cartridge round at its base from an aft linkage bracket within an ammunition chain, said tab comprising:

a plate having an obverse surface for engaging the base of the cartridge round and a reverse surface for engaging the aft linkage bracket, said plate being oriented along a longitudinal direction of the ammunition chain and a lateral direction orthogonal to an axial direction of the cartridge round;

a pair of legs extending from flanking sides of said plate in said axial direction towards the aft linkage bracket; and a pair of feet extending substantially parallel to said plate, each foot from a respective leg of said pair of legs, wherein the guidance tab is composed of polyamide-imide (PAI).

5. The tab according to claim 4, wherein a pair of rivets secures said pair of feet to the aft linkage bracket.

6. The tab according to claim 4, wherein said PAI includes glass fiber.

* * * * *